United States Patent [19]

Becker et al.

[11] Patent Number: 4,664,356

[45] Date of Patent: May 12, 1987

[54] CONTROL VALVE

[75] Inventors: Manfred Becker, Frankenthal; Hilmar Ortlepp, Mannheim, both of Fed. Rep. of Germany

[73] Assignee: Deere & Company, Moline, Ill.

[21] Appl. No.: 874,779

[22] Filed: Jun. 16, 1986

[51] Int. Cl.[4] ..... F15B 13/04

[52] U.S. Cl. ..... 251/175; 91/465; 137/596; 137/625.69; 137/865

[58] Field of Search ..... 91/465; 137/596, 625.69, 137/865; 251/158, 175, 189, 191, 900

[56] References Cited

U.S. PATENT DOCUMENTS 2,675,024 4/1954 Clark ..... 251/175 X
3,605,810 9/1971 Moroney ..... 251/175 X

FOREIGN PATENT DOCUMENTS 88813 3/1982 European Pat. Off. .
3332363 3/1985 Fed. Rep. of Germany .

OTHER PUBLICATIONS

Deere & Company, "John Deere Technical Manual", TM-4363, Jun. 1982, pp. 70-25-1 to 70-25-9.

*Primary Examiner*—Gerald A. Michalsky

[57] ABSTRACT

A valve includes a valve housing having a valve bore with a first valve member movable therein to control fluid communication between a pump, a reservoir and a hydraulic function. The first valve member includes annular grooves which receive pressure controlled seals. A second valve member is movable in the valve bore and is connected to an actuator. The first and second valve members cooperate to form a pre-control valve which controls pressurization of the pressure controlled seals. The second valve member also connects the actuator with the first valve member so that the seals are relieved of pressure before the first valve member is moved.

9 Claims, 3 Drawing Figures

FIG. 2
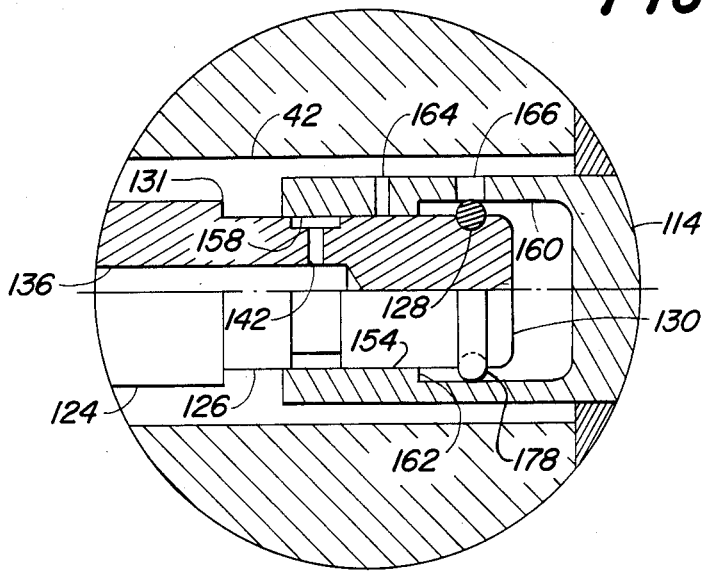
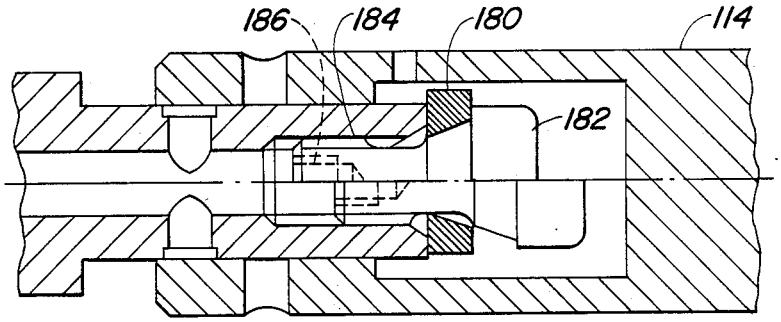
FIG. 3

CONTROL VALVE

BACKGROUND OF THE INVENTION

This invention relates to a valve comprising a control spool movable in a valve bore and having a seal controlled by an actuating means.

In a valve of the kind shown in European patent application EP-A1No. 0 088 813, the seal is always compressed between the control spool and the wall of the valve bore so that friction between the seal and the wall of the valve bore adversely effects the degree of accuracy of the adjusting movement, the force required for producing adjustment, and the service life of the seal. However, this friction is necessary only when the seal is required to perform its sealing function.

A valve with an inflatable and deflatable seal is described in GFR patent application No. DE 33 32 363 which was published Mar. 28, 1985.

It would be desirable to provide an efficient and simple device for depressurizing pressurizable valve seals.

SUMMARY OF THE INVENTION

According to this invention, that object is achieved by a pre-control valve between the control spool and an actuator. The pressurization of the seal depends on the relative position of a valve member with respect to the control spool, the valve member and the control spool cooperating to form the pre-control valve.

The actuator first acts on the pre-control valve and initially produces a drop in pressure behind the seal so that after further operation of the actuator, the control spool can be displaced without a substantial amount of friction.

A feed passage communicates the seals with a pump and a discharge passage communicates the seals with a fluid reservoir. The pre-control valve opens and closes the discharge passage. The cross section of the discharge passage is greater than the cross section of the feed passage, so that pressure behind the seal is reduced more quickly that it is built up. This permits rapid movement of the control spool from its neutral position to another position.

The valve member is axially displaceable relative to the control spool between two limit positions, wherein the discharge passage is opened when the valve member is in one of its limit positions.

BRIEF DESCRIPTION OF THE DRAWINGS

FIG. 2 is a view on an enlarged scale of a pre-control valve of the present invention.

FIG. 3 is an enlarged view of another embodiment of a pre-control valve.

DETAILED DESCRIPTION

Figure 1:
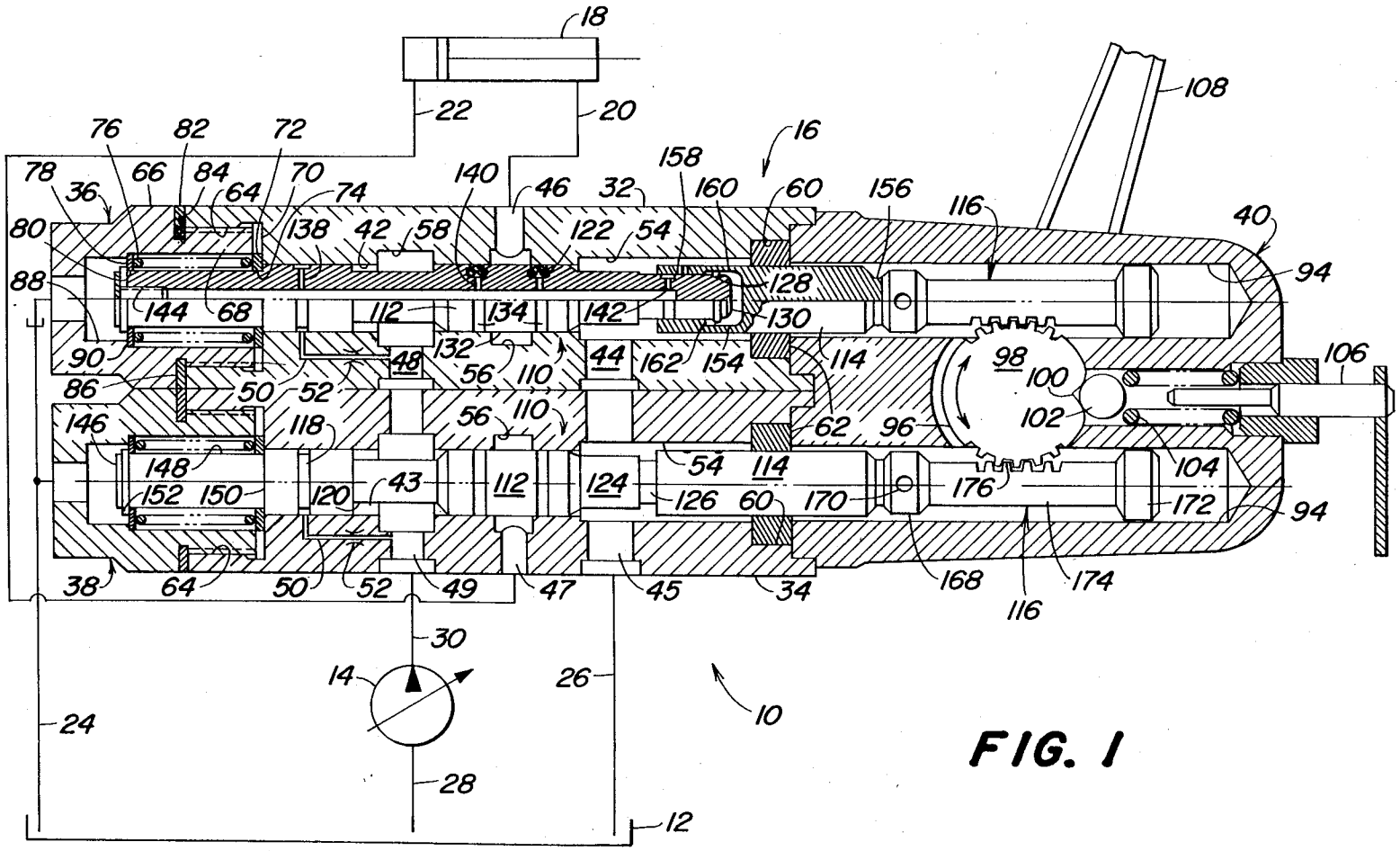
FIG. 1 is a view in vertical section of a hydraulic circuit with a valve.

A hydraulic circuit 10, as shown in FIG. 1, comprises a collecting tank 12 for storing hydraulic fluid, a variable delivery pump 14, a valve 16, a load 18 which can be acted upon on both sides, first and second conduits 20 and 22 between the valve 16 and the load 18, first and second conduits 24 and 26 between the valve 16 and the tank 12, a conduit 28 between the tank 12 and the pump 14 and a conduit 30 between the pump 14 and the valve 16.

The valve 16 includes two virtually identical valve housings 32 and 34, two identical first centering means

36 and 38 which are connected at one end to the valve bodies 32 and 34, and an adjusting device 40 which is flanged onto the two valve bodies 32 and 34 at the other end.

The housings 32 and 34 have respective longitudinal valve bores 42 and 43. Bores 42 and 43 are intersected by return flow passages 44 and 45, discharge flow passages 46 and 47 and feed flow passages 48 and 49. Feed conduits 50, which are much less is diameter, communicate bores 42 and 43 the feed flow passages 48 and 49. Each passage 50 includes a restrictor 52. Annular grooves 54 communicate bores 42 and 43 with return passage 44 and 45. Annular groves 56 communicate bores 42 and 43 with discharge passages 46 and 47. Annular grooves 58 communicate bores 42 and 43 with feed flow passages 48 and 49. The annular groves 54 extends as far as the adjusting body 40. In the region adjoining the adjusting body 40, the longitudinal bores 42 and 43 have enlarged portions 60 which receive sealing rings 62. Each bore 42 and 43 has an enlarged portion which receives the centering means 36 and 38. The difference between the two valve housings 32 and 34 is that the feed flow passage 49 and the return flow passage 45 of the lower valve housing 34 is formed as through bores and not as blind bores, as in the case of passages 48 and 44 of the upper valve housing 32.

Each centering means 36 and 38 comprises a sleeve 66 having a cylindrical projection 68 which is screwed into the enlarged portion 64 in the valve housing 32 and 34 associated therewith, a disc 72 with an opening 74, which is inserted between the cylindrical projection 68 and an inner end wall 70 of the recess 64, a coil compression spring 76, a further disc 78 with an opening 80, and an annular seal 82 which is compressed between an outer end wall 84 of the valve housing 32 and 34 and the end wall 86 of the sleeve 66, which is towards said end wall 84. A stepped bore 88 which extends within the sleeve 66 forms a shoulder or stop 90 against which the further disc 78 can be caused to bear, and communicates by way of a reduced diameter bore 92 with the first conduit 24 that goes to the tank 12.

The adjusting device 40 includes two blind bores 94 which are aligned with the longitudinal bores 42 and 43 of the valve housing 32 and 34. The bores 94 are apertured at their mutually facing sides, approximately at a position halfway along their length, by a slot 96 for a part of a pinion 98 to pass therethrough. On its periphery, the pinion 98 has a notch 100 for receiving an arresting ball 102 under the force of a compression spring 104. The pinion 98 can be fixed in position by a control screw 106 and the ball 102. The pinion 98 is rotated by a lever 108 non-rotatably connected thereto. The pinion 98 is rotatable, as long as the screw 106 does not set the arresting ball 102 in its blocking mode. The entire adjusting device 40 is clamped to the valve housing 32 and 34 by way of screw members (not shown) and sealed with respect thereto in the usual manner. The pinion 98, jointly with the lever 108, forms an actuating means, and the notch 100, the ball 102 and the spring 104 operate in combination as a second centering means.

The bores 42 and 43 each receive a three-part spool 110. Each spool 110 comprises a control spool or first valve member 112, a connecting or second valve member 114 acting together with the first valve member 112 as a series or pre-control valve, and a rack 116. On its periphery, beginning from the centering means 36 and 38, each control spool 112 is provided with a feed annular groove 118, a feed flow annular groove 120 and two trapezoidal grooves 122. A stem 130 projects from spool 112 to form larger and smaller diameter portions 124 and 126, respectively. The annular groove 118 is somewhat wider that the diameter of the conduit 50, and the annular groove 120 is somewhat wider that the width of groove 58. The stem 130 forms the end region of the control spool 112. Referring now to FIG. 2, a stop or shoulder 131 is formed on the periphery of the control spool between portions 124 and 126. The two trapezoidal grooves 122 are formed symmetrically in an annular portion 132 between the feed flow annular groove 120 and the portion 124 and are provided with seals of variable shape, in the form of inflatable seal members 134. The configuration and the mode of operation of such inflatable seals 134 are described in detail in aforementioned published GFR patent application No. DE No. 33 32 363 and in abandoned U.S. application Ser. No. 620,991 filed June 15, 1985, the disclosure of which is hereby incorporated into this description. An internal blind bore 136 extends axially in the control spool 112 from the end which is towards the centering means 36 and 38, into the region of the portion 126. The bore 136 communicates with the feed annular groove 118 by way of a radially disposed feed passage 138, with the grooves 122 by way of radially disposed bores 140 forming a seal discharge, and with the surface of portion 126 by way of a radial discharge passage 142 which is a control discharge. The feed conduit 50 and the end passage 138 jointly form the feed means per se. At the open end of the control spool 112, which extends into the centering means 36 and 38, the internal bore 136 is closed off by a screw-in plug 144 having a wide head 146. In the end region which is towards the centering means 36 and 38, the control spool 112 has a reduced portion 148, the outside diameter of which is almost the same as the width of the openings 74 and 80 in the discs 72 and 78 in the centering means 36 and 38. The reduced portion 148 is concentrically surrounded by the compression coil spring 76 and the two discs 72 and 78. In a central or neutral position of the control spool 112, the one disc 72 comes to bear against a shoulder 150 between the reduced portion 148 and the following part of the control spool 112, and the further disc 78 bears against a support disc 152 which is clamped in position of the control spool 112. Also in this neutral position the feed conduit 50 communicates with the feed annular groove 118, the end flow passage 48 communicates with the feed flow annular groove 120, the return flow passage 44 communicates with the portion 124, and the annular groove 56 is located between the grooves 122 with the inflatable seals 134.

At its end region which is towards the control spool 112, each cylindrical valve member 114 is provided with a stepped bore 154 which occupies almost a third of its total length while at its end region which is towards the rack 116, it is provided with a flattened portion 156 having a bore (not shown). The valve member 114 has an outside diameter which is approximately the same as the inside diameter of the longitudinal bores 42 and 43. At the transition from the valve housing 32 and 34 to the adjusting device 40, the member 114 is sealingly surrounded by the sealing ring 62. As best seen from FIG. 2, the stepped bore 154 has a smaller diameter bore 158, and further inwardly, larger diameter bore 160, with a step or shoulder therebetween. The smaller bore 158 communicates with the portion 124 by way of an opening 164 and the larger bore 160 communicates with portion 124 by way of an entry bore 166.

The racks 116 are substantially in the form of an "H", wherein a side limb 168 which is at the left in FIG. 1 is of a forked configuration for pivotably accommodating the valve member 114, with a connecting pin 170. It, like also a right-hand side limb 172, are round and are slidably supported in blind bore 94. A transverse limb 174 is provided with a flat tooth arrangement 176 which engages with the pinion 98.

A securing wire 178 is fitted into the holding groove 128 for engagement with the valve member 114. For that purpose, the stem 130 is pushed into the stepped bore 154 in the valve member 114 until the holding groove 128 is aligned with the bore 166. The securing wire 178 can then be inserted through the bore 166 and fitted into the holding groove 128.

In the construction shown in FIG. 3, the control spool 112 can also be axially connected to the valve member 114 by way of an expandable disc 180 and a screw 182 of tapering configuration and with a head, having a hexagonal recess 186 disposed in the shank 184 thereof. The expandable disc 180, like the securing wire 178, thus act as a stop means. For that purpose, in the dismantled condition, the expandable disc 180 with the screw 182 is first fixed on the end of the control spool 112 which is at the right in the drawing, for which purpose in that situation the end of the internal bore 136, which is towards the valve member 114, opens towards the end of the control spool 112 and is provided with a female screw thread into which the screw 182 can be screwed. The stem 130 is then introduced into the stepped bore 154 and the screw 182 is tightened by way of a long key with an external hexagonal crossection of suitable size, the key being inserted through the internal bore 136 from the other end and the screw 182 being tightened in that way until the expandable disc 180 has expanded to an outside diameter which is larger than the inside diameter of bore 158.

The inflatable seals 134 are pressurized when the control spool 112 is in the neutral position and fluid cannot flow back to or from the load 18, thus blocking movements of the load 18. On the other hand, the pressure in the inflatable seals 134 can be retracted into the trapezoidal grooves 122 to a position beneath the outside surface of the control spool 112.

MODE OF OPERATION

The description which follows takes as its starting point an initial condition in which the spool 112 is in its neutral position and the feed flow annular groove 120 is pressurized. The valve 16 is to be adjusted in such a way that pressure fluid is fed to the right-hand end of the load 18 and is taken away from the load at the left-hand end.

For that purpose, the lever 108 is pivoted in the clockwise direction as viewing the drawing, and, by way of the pinion 98, entrains the rack 116 and the two valve members 114 in opposite directions. The upper valve member 114 thus moves towards the right until the shoulder 162 bears against the wire 178. Just before that happens, the valve member 114 slides with its end over the discharge passage 142 and releases the flow of pressure fluid from the internal bore 136 through the opening 164 into the portion 124 so that the pressure behind the inflatable seals 134 can be reduced and the inflatable seals can be contracted. After the inflatable seals have contracted to beneath the surface of the control spool 112, the control spool 112 is substantially free of frictional forces relative to the longitudinal bore 42.

The lower valve member 114 moves towards the lower control spool 112 and comes to bear with its end against the stop 131. In that position, the opening 164 is aligned with the discharge passage 142 and the pressure fluid in the internal bore 136 and behind the inflatable seals 134 can flow away into the region of portion 124. In that way, the lower control spool 112 is also free of frictional forces and can be moved axially in the longitudinal bore 42. Now, further pivotal movement of the lever 108 in the clockwise direction also results in displacement of the two control spools 112 themselves as the upper control spool is entrained, by way of the condition of abutment of the securing wire 178, and the lower control spool is entrained by way of the valve member 114 bearing against the stop 131, such entrainment being produced by the valve members 114 and the racks 116. The pivotal movement of the lever 108 is continued until the feed flow annular groove 120 of the upper control spool 112 has produced a communication between the annular groove 58 and the discharge flow passage 48 and at the same time the portion 124 has formed a communication between the annular groove 58 of the lower valve body 34 and the return flow passage 44. The pump 14 then delivers pressure fluid through the feed flow passage 48, the annular groove 58, the feed flow annular groove 120 of the upper spool 112, the discharge flow passage 46 and the conduit 20, to one end of the load 18, while fluid issues at the other end of the load 18 by way of the conduit 22 and flows to the tank 12 by way of the annular groove 56 of the lower valve body 34, the portion 124, the return flow passage 44 and the conduit 26. Pressure fluid which passes into the feed conduit 50 from the feed flow passage 48 cannot pass into the feed annular groove 118 into the control spool 112 as the displacement of the upper and lower spools 112 means that the feed conduit 50 is no longer aligned with the feed annular grooves 118. Thus, during the movement of the control spools 112, no pressure builds up in the bores 136. The rotation of the pinion 98 urges the arresting ball 102 out of the notch 100, against the resisting force of the spring 104. In addition, the further disc 78 moves towards the disc 72 on the reduced portion 148 of the upper control spool 112, and in so doing compresses the compression coil spring 76. In the same manner, the disc 72 moves towards the further disc 78 against the force of the compression coil spring 76 on the reduced portion 148 of the lower control spool 112, with the further disc 78 being held against the abutment 90 of the stepped bore 88.

When the load 18 has taken up the desired position, the lever 108 is pivoted again in the anticlockwise direction whereby the valve members 114 and the racks 116 of the two spools 112 are moved back again towards the original neutral position. Unlike the situation as described above, the coil compression springs 76 which are in the centering means 36 and 38 cause the control spools 112 to be held firmly in contact against the valve members 114 so that they retain the same spatial relationship as that which they had assumed during the displacement of the control spools 112. As soon as the control spools 112 have reached a position in which the discs 72 and 78 in the centering means 36 and 38 occupy almost their original position, the feed conduits 50 come back into alignment with the annular grooves 118 and pressure fluid passes from the feed flow passages 48 in the internal bores 136 to the inflatable seals 134. However, no pressure is yet built up as there is still an opening to the return flow passage 44, by way of the openings 164. The feed flow of pressure fluid into the internal bores 136 takes place relatively slowly, by virtue of the restrictors 52 in the feed conduits 50. It also occurs more slowly than the discharge flow through the openings 164 as the restrictors 52 are smaller in width than the discharge passages 142. When the control spools 112 have returned to their original position, the arresting ball 102 ensures that the pinion 98 and therewith the racks 116 and the valve members 114 also occupy their precisely established starting position. In that position, the discharge passages 142 are again closed off by the valve members 114 in the smaller bore 158, and pressure can be built up behind the inflatable seals 134. The valve 16 is then once again in its starting condition.

We claim:

1. A valve comprising:

a housing defining a valve bore therein;

a first valve member movable in the valve bore to control fluid communication to a hydrauic function;

a pressure controlled seal for sealing and unsealing between the first valve member and a wall of the valve bore;

a movable actuator;

a second valve member connected to the actuator and movable in the valve bore in response to movement of the actuator, a portion of the second valve member receiving a portion of the first valve member; and a pre-control valve for controlling pressurization and depressurization of the pressure controlled seal in response to movement of the second valve member relative to the first valve member, the second valve member also being engageable with the first valve member to transmit movement of the actuator to the first valve member.

2. The valve of claim 1, further comprising:

a feed passage for communication a pressure source with the seal; and a discharge passage for communicating the seal with a fluid reservoir, the pre-control valve operation to open and close the discharge passage.

3. The valve of claim 2, wherein:

the discharge passage has a cross-sectional area which is larger than the cross-sectioanl area of the feed passage.

4. A valve of claim 2, wherein:

the second valve member is axially slidable relative to the first valve member between a pair of limit positions, the pre-control valve opening the discharge passage when the second valve member is in one of said limit positions.

5. The valve of claim 4, wherein:

the first valve member includes a first discharge conduit communicated with the seal; and the second valve member includes a second discharge conduit communicated with a fluid reservoir, the first and second discharge conduits together comprising at least a portion of the discharge passage, the first and second discharge conduits communicating with each other when the second valve member is in one of its limit positions.

6. The valve of claim 4, further comprising:

first centering means for holding the first valve member in a neutral position; and second centering means for holding the actuating means and the second valve member in neutral positions, the second valve member neutral position being between its limit positions.

7. The valve of claim 4, wherein:

the first valve member carries abutment means for engaging the second valve member to define the limit positions of the second valve member.

8. The valve of claim 2, wherein: the feed passage has a fluid restriction therein.

9. The valve of claim 1, wherein:

the valve housing includes a feed conduit therein for communicating a pressure source with the bore; and the first valve member having an axial bore therein communicated with the seal, and having a feed passage extending from the axial bore to an outer surface of the first valve member, the first valve member also having a neutral position wherein the feed conduit is in communication with the feed passage.

* * * * *

UNITED STATES PATENT AND TRADEMARK OFFICE

CERTIFICATE OF CORRECTION

PATENT NO. : 4,664,356

DATED : 12 May 1987

INVENTOR(S) : Manfred Becker et al.

It is certified that error appears in the above-identified patent and that said Letters Patent is hereby corrected as shown below:

Col. 6, line 41, change "communication" to -- communicating --; line 44, change "operation" to -- operating --; and line 48, change "cross-sectioanl" to -- cross-sectional --.

Signed and Sealed this

Twenty-sixth Day of January, 1988

*Attest:*

DONALD J. QUIGG

*Attesting Officer*

*Commissioner of Patents and Trademarks*